US007806066B1

(12) United States Patent
Fell

(10) Patent No.: US 7,806,066 B1
(45) Date of Patent: Oct. 5, 2010

(54) ELECTRIC SERVO MOTOR CABLE STEERING POWER HEAD

(76) Inventor: William P. Fell, 549 W. Fireweed Ln, Anchorage, AK (US) 99503

( * ) Notice: Subject to any disclaimer, the term of this patent is extended or adjusted under 35 U.S.C. 154(b) by 0 days.

(21) Appl. No.: 12/315,828

(22) Filed: Dec. 5, 2008

Related U.S. Application Data

(60) Provisional application No. 61/062,323, filed on Jan. 25, 2008.

(51) Int. Cl.
*B63H 25/04* (2006.01)

(52) U.S. Cl. ..... 114/144 R; 440/62

(58) Field of Classification Search ..... 114/144 R, 114/144 E; 440/62, 53, 63; 74/480 B
See application file for complete search history.

(56) References Cited

U.S. PATENT DOCUMENTS 3,670,687 A * 6/1972 Rowley ..... 440/62
4,993,976 A * 2/1991 Kabuto et al. ..... 114/144 R
5,097,714 A * 3/1992 Kabuto et al. ..... 114/144 R
5,111,761 A * 5/1992 Gilbertson ..... 114/144 R
5,408,945 A * 4/1995 Bohlin ..... 114/144 R
5,893,426 A * 4/1999 Shimizu et al. ..... 180/400
6,413,126 B1 * 7/2002 Johnson ..... 114/144 R

* cited by examiner

*Primary Examiner*—Lars A Olson
(74) *Attorney, Agent, or Firm*—Michael J. Tavella

(57) ABSTRACT

A device that allows an operator to move steering gear at the same speed as the control device. The invention uses two electric motors with forward and reverse capabilities that are linked to function synchronously by a chain or belt that is carried by sprockets or pulleys on each of the drive motors. A second sprocket or pulley is attached to the facing of one of the drive motor sprockets (pulley). This sprocket (pulley) is linked by a chain or belt to a cable drive system by another sprocket (pulley) that is attached to a cable drive shaft. Activating the drive motors causes a cable be pulled or pushed. The cable, which is attached to the item to be moved, in turn drives this item as desired. These items can include an outboard motor, an out drive for an inboard motor, wheels, valves, etc.

17 Claims, 6 Drawing Sheets

ELECTRIC SERVO MOTOR CABLE STEERING POWER HEAD

CROSS REFERENCE TO RELATED APPLICATIONS

This application claims benefit of Provisional application 61/062,323 filed Jan. 25, 2008.

STATEMENT REGARDING FEDERALLY SPONSORED RESEARCH AND DEVELOPMENT

Not Applicable

BACKGROUND OF THE INVENTION

1. Field of the Invention

The invention is related to a cable steering power head and particularly to an electric servo motor cable steering power head.

2. Description of the Prior Art

Steering a boat or operating certain remote devices, such as wheels, valves or other devices usually requires an operator to control an object—a tiller, a wheel, or some other control device that causes the device to move. For example, such a device can cause a rudder on a boat to move, which in turn, causes the boat to change direction. Often, there is a time delay between the movement of the control device and the actual response of the boat or device. In the case of a boat, this causes over steer because the operator does not feel the boat respond immediately to the movement of the control. As a result, the operator holds the control device in a turning position far longer than necessary. Then, as the boat moves too far in the turn, the operator moves the wheel back past the starting point to correct the course. Because the correction does not happen immediately, the operator continues to hold the correction too long. This often results is a series of correcting maneuvers to bring the boat back to the desired course. What is needed, therefore, is a system that can move a device, such as the steering gear of a boat in exact synchronicity with the movement of the control device.

BRIEF DESCRIPTION OF THE INVENTION

The instant invention overcomes these difficulties. It is a device that allows an operator to move a boat's steering gear at the same speed as the control device. This means, the steering gear can be moved from full starboard to full port in a matter of seconds. The invention uses two electric motors with forward and reverse capabilities that are linked to function synchronously by a means for transferring motion that is carried by means for driving on each of the drive motors. A second means for driving is attached to the facing of one of the drive motor means for driving. This means for driving is linked by means for transferring motion to a cable drive system by another means for driving that is attached to a cable drive shaft. Activating the drive motors in a forward or reverse direction causes a cable that is installed in the cable drive to be pulled or pushed. The cable, which is attached to the item to be moved, in turn drives this item as desired. These items can include an outboard motor, an out drive for an inboard motor, wheels, valves, etc.

The system is controlled by a microprocessor in a circuit board. It is electrically connected to a potentiometer, which is used to control the drive motors. The operation is controlled by a user through a steering wheels and/or joystick, which are in turn, connected to the circuit board.

DETAILED DESCRIPTION OF THE INVENTION

Figure 1:
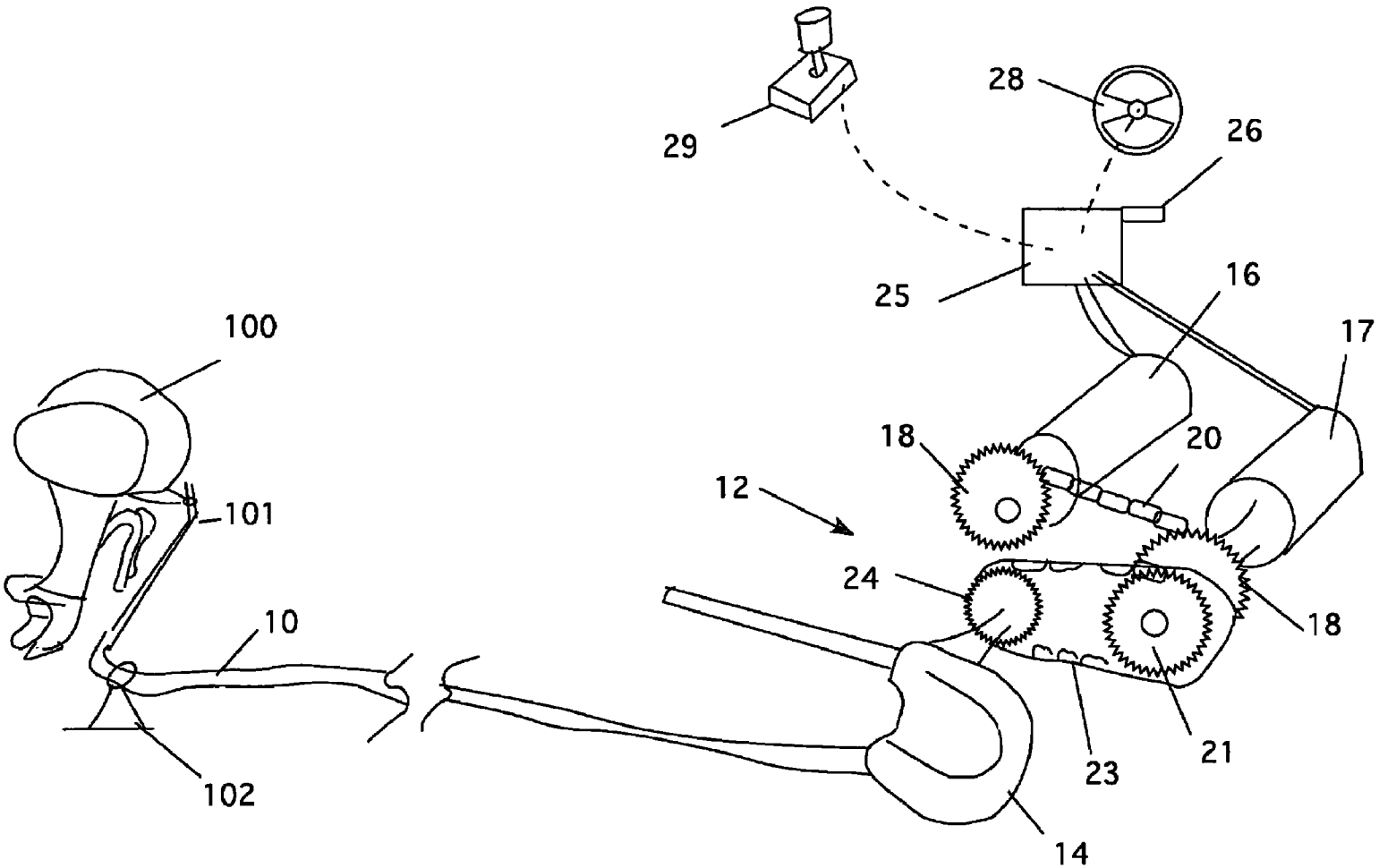
FIG. 1 is a diagrammatic view of a boat, motor and control device.

Referring now to FIG. 1 *a*, a diagrammatic view of the system is shown. This is one of several possible applications for this system. Here, an outboard motor 100 is shown. The motor has a cable connector 101 to attach a control cable for steering in the normal manner common to the art. A control cable 10 is attached to the connector in the normal manner. The cable is routed through one or more cable anchor(s) 102 as necessary as the cable is ran to the steering mechanism 12. The steering mechanism has a cable gear 14, through which the cable 10 is routed. The cable gear is designed to rotate forwards and backwards to drive the cable into or out of the gear housing. This motion is then translated to the cable connector on the motor, which then turns the motor in the desired direction. Note that the other end of the cable remains unconnected and rides in a storage tube at the other end of the cable drive. The length of the tube is approximately 18. In normal operation, of the device the cable actually only moves a few inches in either direction.

In the preferred embodiment, the steering mechanism 12 has two electric motors 16 and 17 that are reversible. Tow motors are preferred because the second motor acts as a backup for the first. Of course, one motor is sufficient to operate the device. However, because the device may be used in a boat operating some distance from shore, a backup motor is preferred.

Moreover, it is important to recognize that any type of drive motor can be used with the system. It is the power servo and the control system that is unique. This is because the servo allows for fast operation of the controlled device. Such a system allows for almost instant feedback as to the position of a rudder, or boat motor for example. While compact drive motors are preferred, any type of motor can be used from a gasoline engine to a solar or wind powered motor. The key is the control servo system that is the heart of the system.

The motors have means for driving, operably connected to the shaft of motors and means for transferring motion attached to the means for driving. The means for driving are sprockets and means for transferring motions or pulleys and belts.

The means for driving 18 are connected to the means for transferring motion 20 (note only a portion of the means for transferring motion 20 is shown in this diagram). Motor 17 has an extension shaft that has a second means for driving 21 attached. The second means for driving has a means for transferring motion 23 that drives means for driving 24 that is attached to the cable gear 14. Thus, as the two motors 16 and 17 turn either forward or reverse, the two means for transferring motions also turn, which causes the cable to be pushed or pulled in synchronization with the movement of the motors. This movement, as mentioned above, causes the motor and the boat to turn.

The motors are controlled by a circuit board 25 that uses a potentiometer 26 to control the speed of the motors. The circuit board 25 is also connected electrically to a helm means for steering such as a wheel 28 or a joystick 29. Either of these devices is used to produce an electrical signal that causes the motors to steer the boat by turning in the desired direction. As noted above, the effect is instantaneous control of the boat, so that the operator feels immediate response to the movement of the helm.

Figure 2:
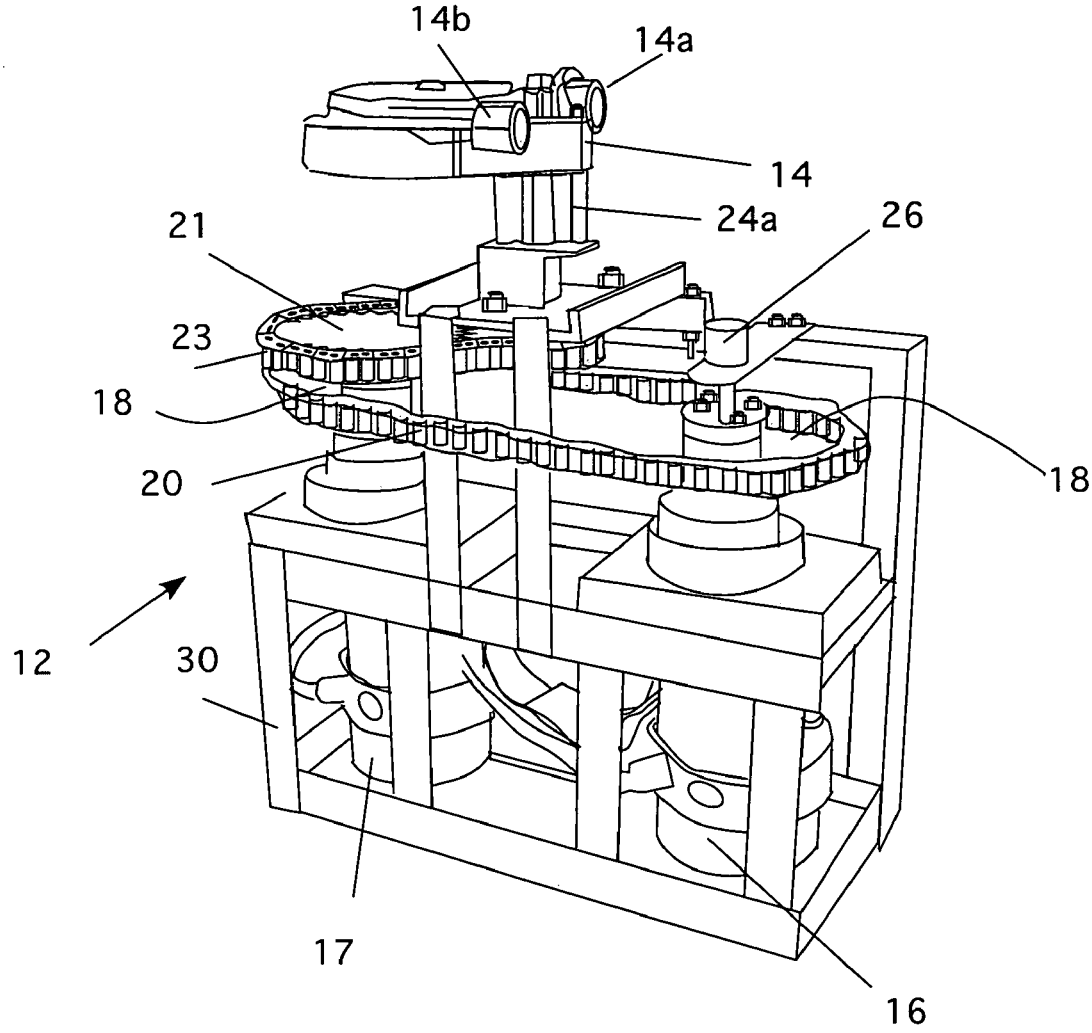
FIG. 2 is a perspective view of the motors and housing.

FIG. 2 is a perspective view of the motors and housing. In this figure, the components of the steering system 12 are shown in detail. Two electric motors 16 and 17 with forward and reverse capabilities are positioned in a frame 30 as shown. The frame supports the components and serves as a housing for the system 12. Note that the frame shown is only one example and any other style or design of frame can be used. The motors 16 and 17 are linked to function synchronously by a means for transferring motion 20 that is carried by means for driving 18 on each of the drive motors. A second means for driving 21 is attached to the facing of one of the drive motor means for driving, This means for driving is linked by means for transferring motion 23 to the cable drive gear 14 by another means for driving 4 (not shown) that is attached to a cable drive shaft 24*a*. By activating the drive motors in either a forward or reverse direction, a cable that is installed in the cable drive to be pulled or pushed out of the cable gear 14, through fittings 14*a* and 14*b*. Note in this figure, the cable 10 is not shown.

FIG. 2 also shows the potentiometer 26 that is used to help control the drive motors 16 and 17.

Figure 3:
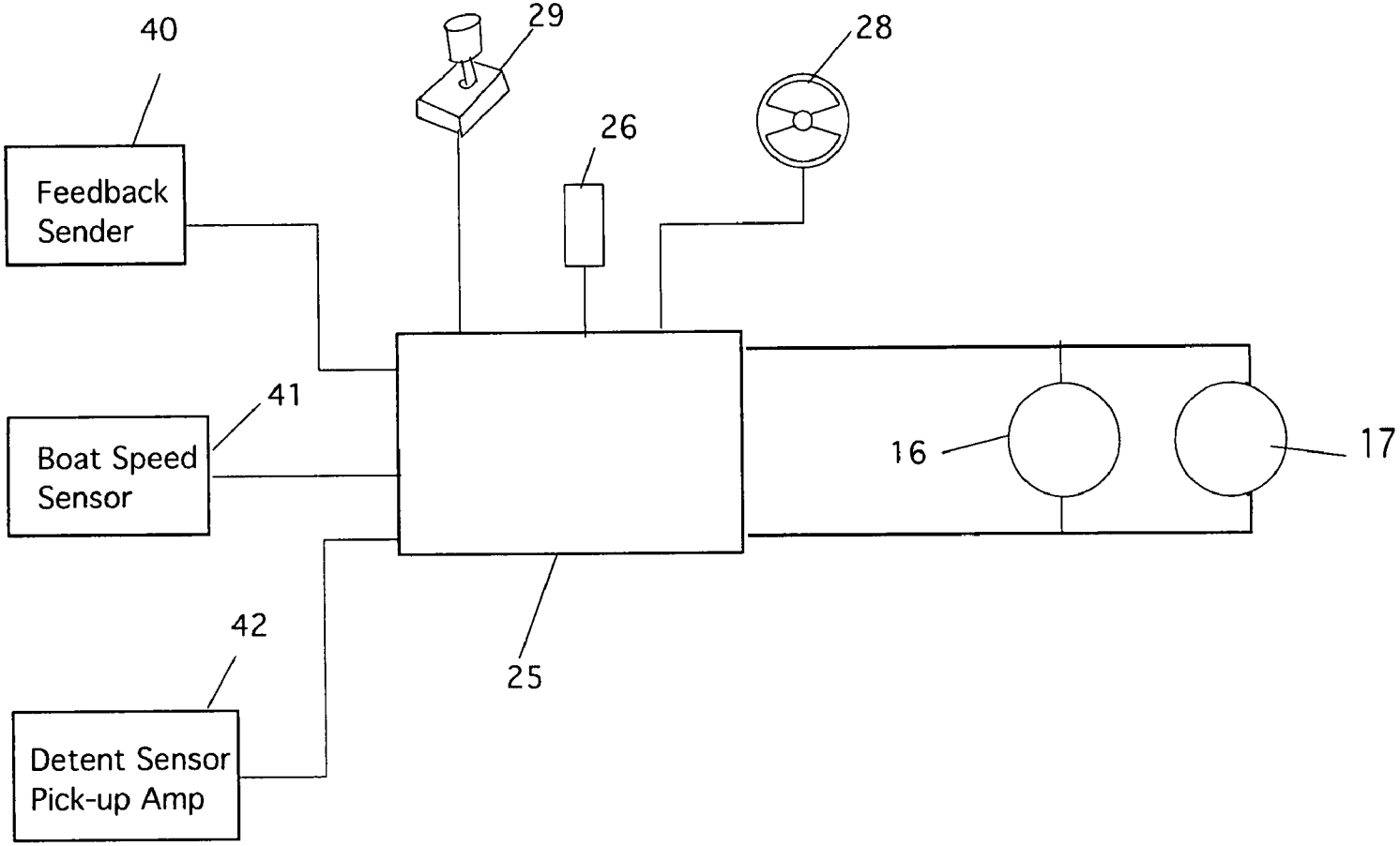
FIG. 3 is a block diagram of a motor controller showing the speed sensing and motor speed control systems.

FIG. 3 is a block diagram of a motor controller showing the speed sensing and motor speed control systems. Here, the circuit board 25 is shown with three inputs: a feedback sender 40, a detent sensor 41, and a boat speed sensor 42. The first sensor is used for the joystick or wheel operation. The boat speed sensor tells the circuit board the current speed of the boat. The circuit board then sends a signal to the potentiometer 26, which controls the speed of the drive motors 16 and 17. Details of these systems are further provided in my copending application Ser. No. 11/906,897, which is incorporated herein by reference.

Figure 4:
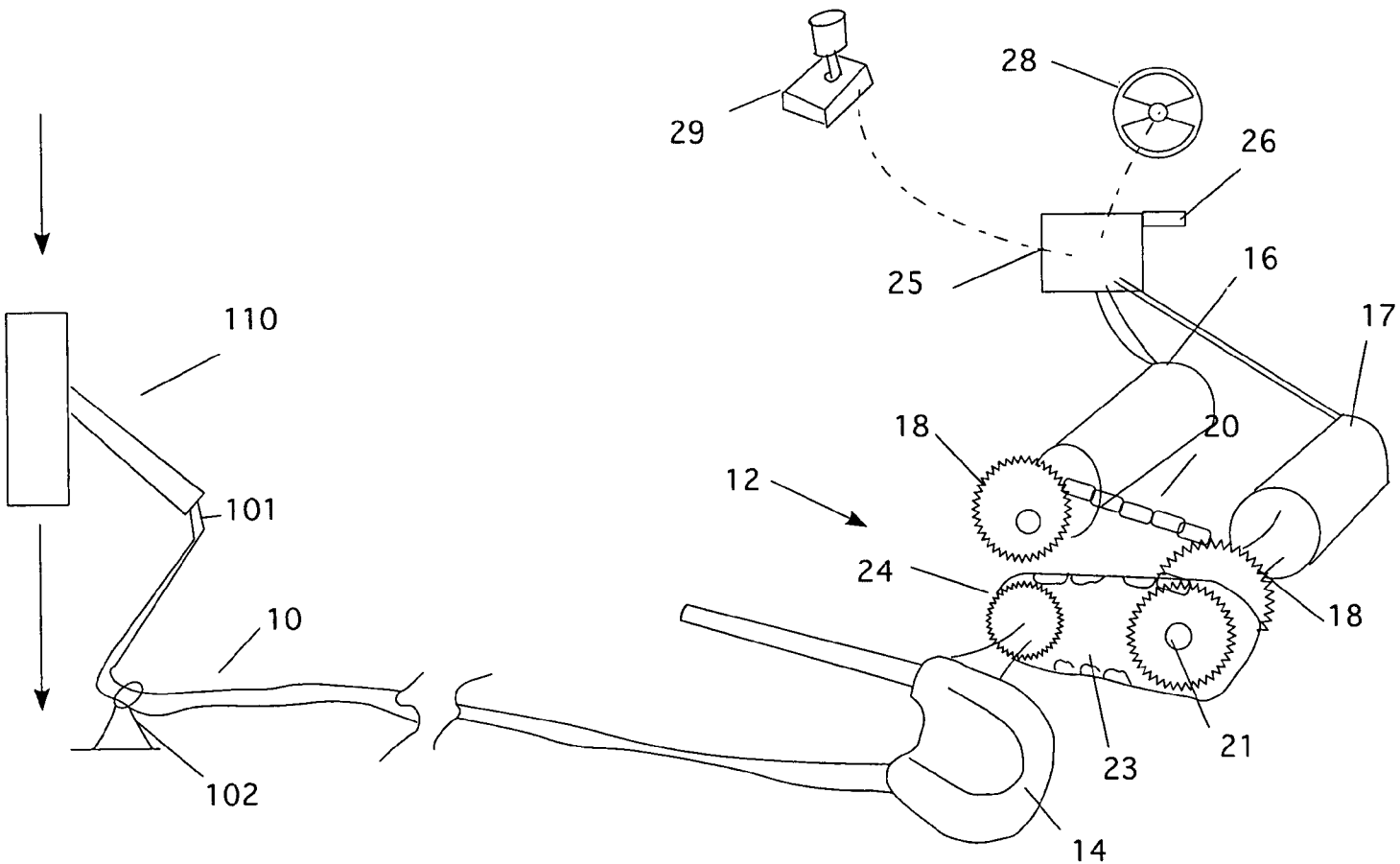
FIG. 4 is a diagrammatic view of the system showing a valve.

FIG. 4 is a diagrammatic view of the system showing a valve 110. As discussed above, the motors can be used to drive a number of things that can be controlled. In this case, a valve 110 is connected to the cable such that as the cable is moved, the valve is opened or closed as desired.

Figure 5:
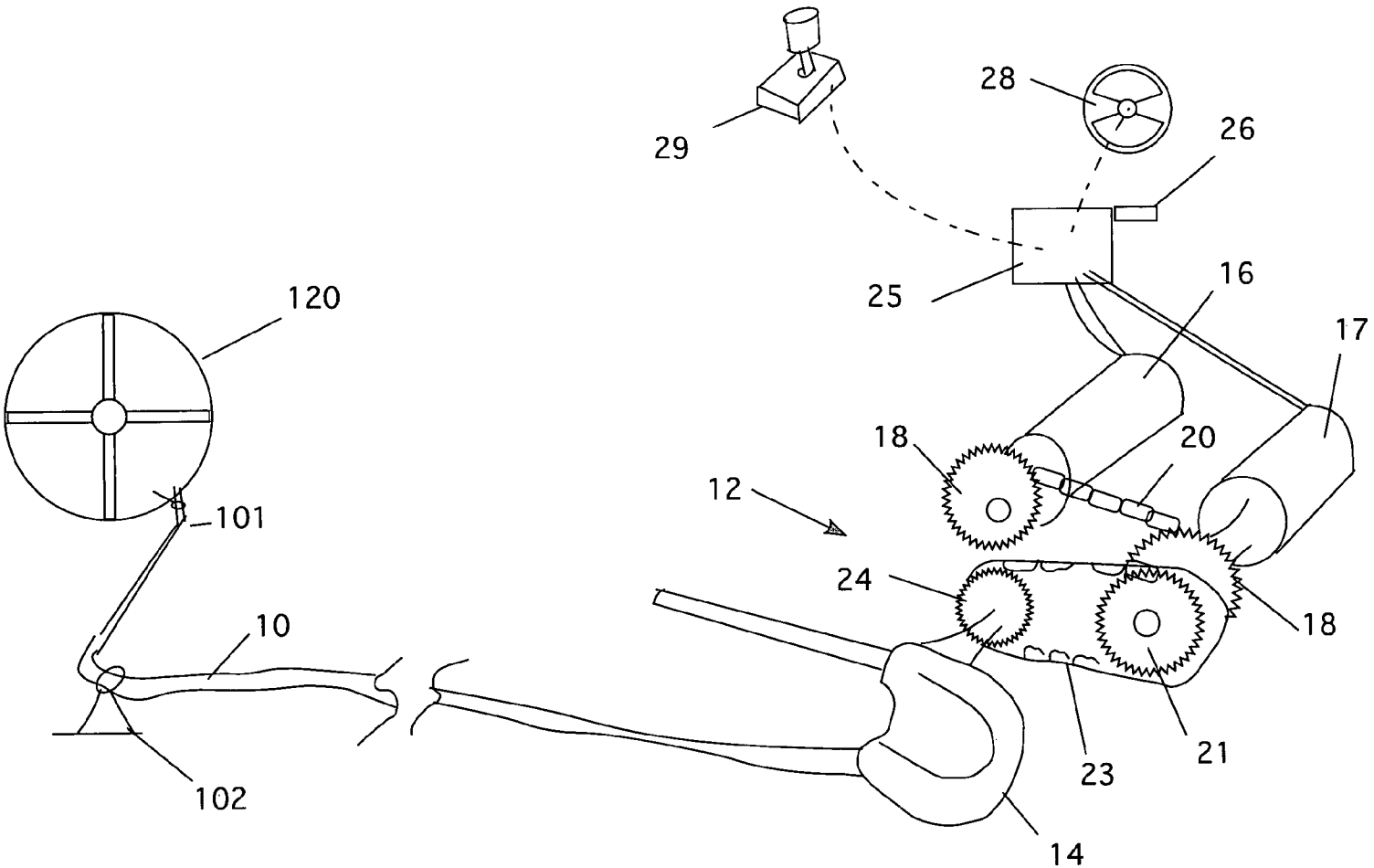
FIG. 5 is a diagrammatic view of the system showing a wheel.
Figure 6:
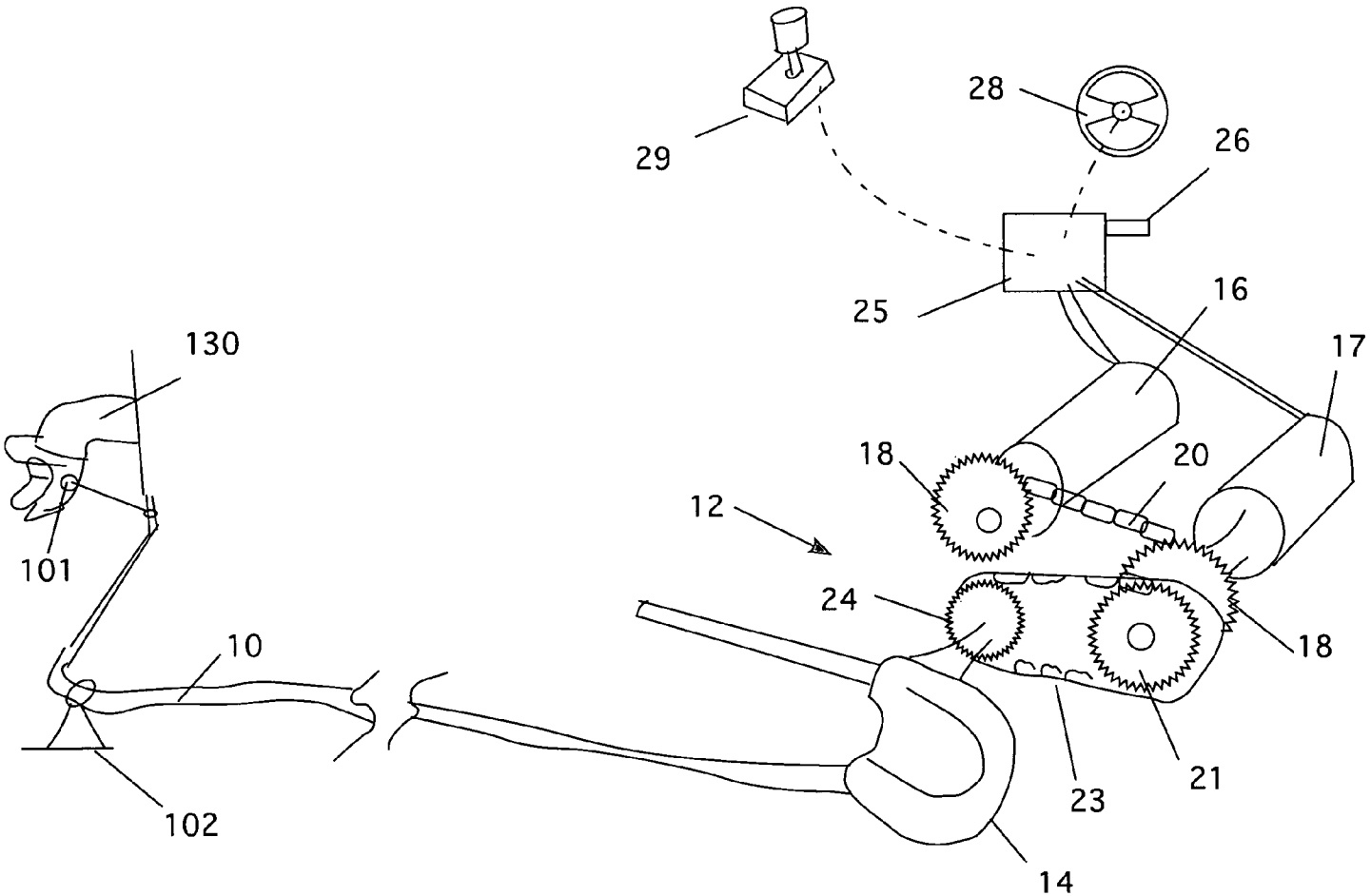
FIG. 6 is a diagrammatic view of the system showing an out drive of an inboard motor.

FIG. 5 is a diagrammatic view of the system showing a wheel 120. FIG. 6 is a diagrammatic view of the system showing an out drive 130 of an inboard motor. Similarly, these devices are also operated using the cable drive system. Note that all of the items being operated are considered "steerable objects".

The advantage of the cable drive system allows the operator to turn the device in "real time" as if the operator were turning the device by hand. This allows the operator to provide exact control of the system without the inherent tendency to overcorrect, which requires a series of moves to stabilize the movement of a boat, or the flow through a valve.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A motorized control comprising:

a) a drive motor, said drive motor having an output shaft;

b) a cable drive in operable communication with said output shaft, said cable drive having a means for driving a cable operably installed thereon;

c) a length of cable having two ends, said length of cable being installed in said cable drive;

d) a steerable object, installed in proximity to said motorized control, said steerable object having an operable control surface, and further wherein one of said two ends of said length of cable is attached to said operable control surface; and h) a means for controlling the operation of said drive motor, said means including a circuit board containing a programmable circuit; wherein said circuit board also has a feedback sender, a detent sensor, and a speed sensor, installed thereon.

2. The device of claim 1 wherein the steerable object is selected from the group of: an outboard motor, a wheel, a valve and an out drive of an inboard motor.

3. The device of claim 1 wherein the means for controlling the operation of said drive motor includes a control device selected from the group of: a wheel and a joystick.

4. The device of claim 3 wherein said means for controlling the operation of said drive motor includes a potentiometer.

5. A motorized control comprising:

a) a first drive motor being installed in a frame, said first drive motor having a forward direction and a reverse direction and an output shaft;

b) a second drive motor also being installed in said frame, said second drive motor having a forward direction and a reverse direction and an output shaft;

c) a first means for driving, operably connected to said shaft of said first drive motor;

d) a second means for driving, operably connected to said shaft of said first drive motor;

c) a first means for transferring motion operably connected to said first and second means for driving;

d) a third means for driving operably attached to the shaft of said second drive motor;

e) a cable drive, also secured to said frame, said cable drive having a means for driving a cable operably installed thereon;

f) a second means for transferring motion operably connected to said third means for driving and said means for driving a cable;

g) a length of cable having two ends, said length of cable being installed in said cable drive;

h) a steerable object, installed in proximity to said motorized control, said steerable object having an operable control surface, and further wherein one of said to ends of said length of cable is attached to said operable control surface; and i) a means for controlling the operation of said first and second drive motors.

6. The device of claim 5 wherein the first and second means for driving are sprockets.

7. The device of claim 6 wherein the means for transferring motion are lengths of chain.

8. The device of claim 5 wherein the first and second means for driving are pulleys.

9. The device of claim 8 wherein the first and second means for transferring motion are belts.

10. The device of claim 5 wherein the third means for driving comprises a sprocket.

11. The device of claim 5 wherein the third means for driving comprises a pulley.

12. The device of claim 5 wherein the means for driving a cable comprises a pulley.

13. The device of claim 5 wherein the steerable object is selected from the group of: an outboard motor, a wheel, a valve and an out drive of an inboard motor.

14. The device of claim 5 wherein the means for controlling the operation of said first and second drive motors includes a control device selected from the group of: a wheel and a joystick.

15. The device of claim 14 wherein said means for controlling the operation of said drive motor includes a potentiometer.

16. The device of claim 15 wherein the means for controlling the operation of said drive motor includes a circuit board containing a programmable circuit.

17. The device of claim 16 wherein said circuit board has a feedback sender; a detent sensor; and a speed sensor, installed thereon.

* * * * *